US006173781B1

(12) United States Patent
Milne et al.

(10) Patent No.: US 6,173,781 B1
(45) Date of Patent: Jan. 16, 2001

(54) SLIP JOINT INTERVENTION RISER WITH PRESSURE SEALS AND METHOD OF USING THE SAME

(75) Inventors: Ranald Milne, Peterhead (GB); Otto Tennoy, Aslesund (NO)

(73) Assignee: Deep Vision LLC, Houston, TX (US)

( * ) Notice: Under 35 U.S.C. 154(b), the term of this patent shall be extended for 0 days.

(21) Appl. No.: 09/181,465

(22) Filed: Oct. 28, 1998

(51) Int. Cl.[7] ..... E21B 7/12; E21B 33/035

(52) U.S. Cl. ..... 166/355; 166/344; 166/359; 166/367; 285/302; 405/223.1; 405/224.4

(58) Field of Search ..... 166/344, 345, 166/346, 355, 359, 367; 285/298, 302, 900; 405/223, 223.1, 224.2, 224.3, 224.4, 225, 195.1

(56) References Cited

U.S. PATENT DOCUMENTS

| | | | | |
|---|---|---|---|---|
| 3,313,345 | | 4/1967 | Fischer | 166/5 |
| 3,353,851 | | 11/1967 | Vincent | 285/302 |
| 3,554,277 | * | 1/1971 | Bauer | 166/344 X |
| 3,647,245 | | 3/1972 | Hanes et al. | 285/106 |
| 3,688,840 | * | 9/1972 | Curington et al. | 166/344 X |
| 3,736,984 | * | 6/1973 | Garrett | 166/208 |
| 3,746,372 | * | 7/1973 | Hynes et al. | 285/900 |
| 3,791,442 | * | 2/1974 | Watkins | 166/355 X |
| 3,955,621 | | 5/1976 | Webb | 166/5 |
| 4,367,981 | | 1/1983 | Shapiro | 405/195 |
| 4,428,433 | * | 1/1984 | Watkins | 166/345 X |
| 4,437,688 | | 3/1984 | Kramer et al. | 285/95 |
| 4,545,437 | | 10/1985 | Denison | 166/345 |
| 4,593,937 | * | 6/1986 | Schawann et al. | 285/18 |
| 4,615,542 | * | 10/1986 | Ideno et al. | 285/302 X |
| 4,626,135 | * | 12/1986 | Roche | 405/224.2 |
| 4,712,620 | | 12/1987 | Lim et al. | 166/355 |
| 5,069,488 | * | 12/1991 | Freyer et al. | 385/302 |
| 5,377,763 | | 1/1995 | Pearce et al. | 166/367 |
| 6,017,168 | * | 1/2000 | Fraser, Jr. et al. | 405/224.4 |

* cited by examiner

*Primary Examiner*—Eileen D. Lillis
*Assistant Examiner*—Jong-Suk Lee
(74) *Attorney, Agent, or Firm*—Madan, Mossman & Sriram, P.C.

(57) ABSTRACT

A pressurized slip joint for a marine intervention riser decouples the flowhead assembly in the moon pool of a vessel from the riser string, enabling safe changeover of equipment during workover operations. One part of the slip joint assembly is coupled to the flowhead assembly through a flexible joint assembly. A second part of the slip joint assembly supports the riser string and is coupled to the tensioning mechanism. The first part may be inserted into the second part and locked in place during workover operations except when equipment changeover is taking place. When changeover is being carried out, the first and second parts are unlocked, so that the flowhead assembly does not move relative to the vessel. In the locked position, a metal-to-metal high pressure seal, with a secondary and tertiary seal controls the pressure in the riser. In the unlocked position, a hydraulically operated dynamic low pressure seal is used.

17 Claims, 3 Drawing Sheets

SLIP JOINT INTERVENTION RISER WITH PRESSURE SEALS AND METHOD OF USING THE SAME

BACKGROUND OF THE INVENTION

1 Field of the Invention

This invention relates generally to offshore drilling systems and more particularly to a pressurized slip joint for use with a marine intervention riser system for workover applications after a well has been drilled. The slip joint enables expeditious operations in the moon pool of a vessel in heavy seas.

2 Background of the Art

Risers for drilling operations typically consist of large diameter pipes extending from the wellhead through an opening in the bottom ("moon pool") of the vessel. Drilling operations are carried out by means of a drill string within the riser. Drilling mud required for drilling is circulated through the drillstring to the drillbit at the bottom of the drillstring, back up the wellbore and through the annulus between the drillstring and the riser. The riser serves to separate the drilling fluid from the surrounding seawater. When drilling operations are carried out in deep water, the danger of buckling of the riser increases. The reason for this is that the riser has the same buckling characteristics as a vertical column and structural failure under compressive loading may occur. To avoid this structural failure, riser tensioning systems are installed on the vessel for applying a tensile force to the upper end of the riser. A variety of such tensioning systems have been used in prior art, including cables, sheaves and pneumatic cylinder mechanisms connected between the vessel and the upper portions of the riser.

Because the riser is fixed at the bottom to the wellhead assembly, wind, wave and tidal action will cause movement of the vessel relative to the top end of the riser. Motion compensating equipment must be incorporated into the tensioning system to maintain the top of the riser within the moon pool. This may include a telescopic coupling arrangement to compensate for heaving motion and a flex joint within the riser to compensate for lateral movement of the vessel. During drilling, pressure inside the riser pipe is comparatively low. However, the pressure may increase if a shallow pocket if gas is encountered and the sliding joint is typically designed to withstand a pressure of 2000 psi or less.

In the case of producing wells, however, the pressure inside the riser can easily approach 10000 psi. Fixed production platforms do not require telescopic risers. In deeper waters, tension leg platforms have been used. Such platforms are subject to more motion than fixed platforms and the risers have to be designed accordingly. On marginal fields where the cost of a production platform would be prohibitive, drilling vessels have been used for production. Production riser pipes for mobile production platforms have been constructed as an integrated unit suspended in tension systems and guides, capable of absorbing the necessary telescopic, lateral and angular movements. U.S. Pat. No. 5,069,488 discloses a telescopic device that is volume and pressure balanced for mobile production platforms. Because of the requirement of no relative vertical motion between the riser and the production vessel, the telescopic system has to be designed to withstand the maximum motion expected in heavy seas.

Marine intervention riser systems are functionally similar to risers used with mobile production platforms in terms of the pressures that are encountered. However, there is one major difference: workover operations typically require a variety of devices to be inserted into the well. Use of these devices requires a considerable amount of human involvement in the vessel. Any system in which the riser pipes in the moon pool have a large vertical movement with respect to the vessel presents a serious safety hazard when humans are preforming workover operations in the vessel. At these times, it is desirable to have no movement between the top of the riser assembly within the moon pool and the vessel. At other times, when humans are not involved, vertical movement of the riser within the moon pool is acceptable: at such times, a system that allows relative motion between the top of the riser assembly within the moon pool and the vessel is acceptable. The present invention is capable of meeting these requirements.

SUMMARY OF THE INVENTION

The present invention provides a slip joint assembly for use in a marine intervention riser system. When devices for workover operations are being installed by humans, the invention is configured to act like a low pressure slip joint with the upper end of the assembly fixed relative to the vessel, allowing for safe installation of the devices. Once the workover devices have been installed, the upper end of the assembly is fixed to the riser and is capable of sealing at high pressures.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawings, in which like elements have been given like numerals.

DETAILED DESCRIPTION OF PREFERRED EMBODIMENTS

Figure 1:
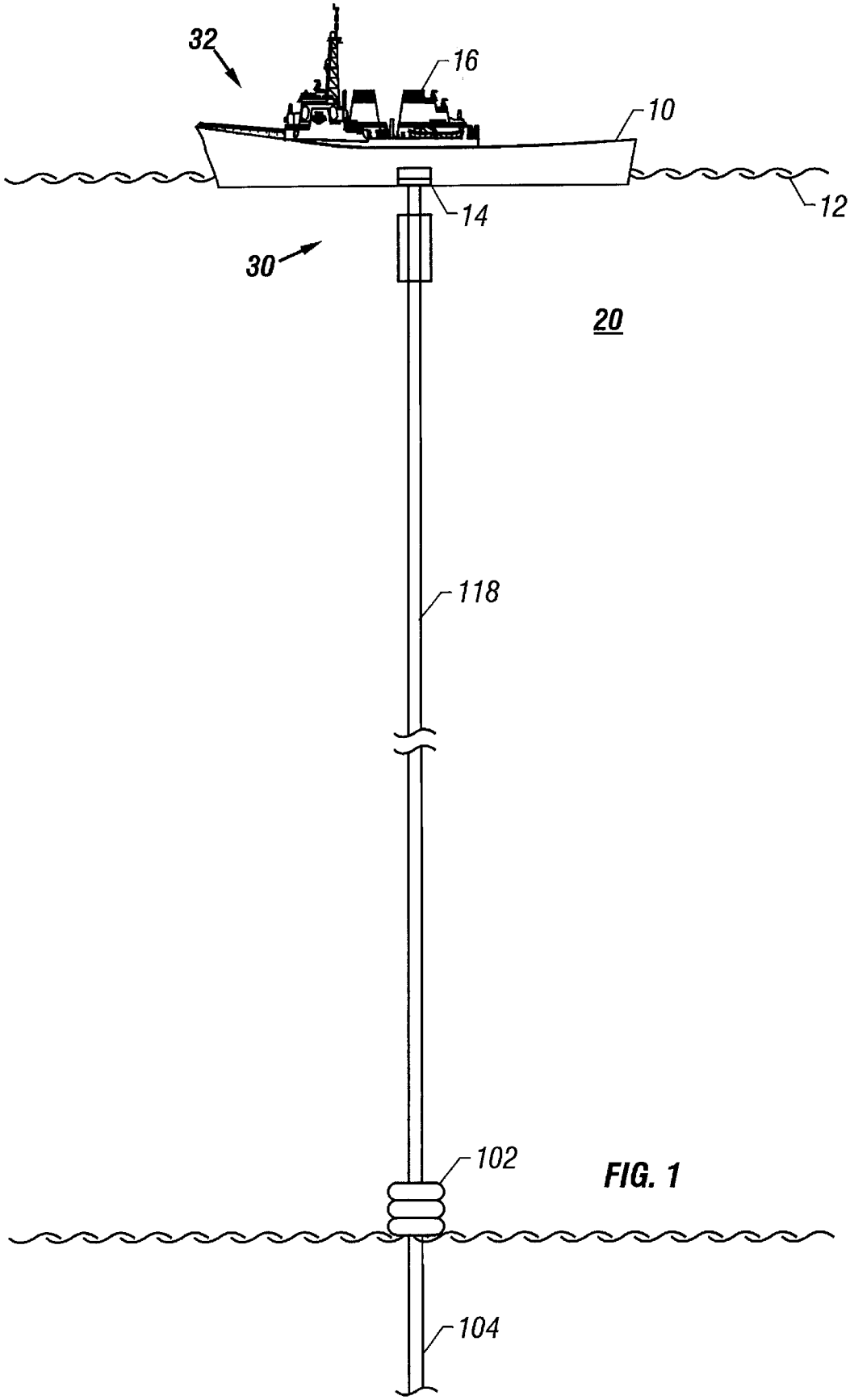
FIG. 1 is an overall elevational view of a riser assembly incorporating the present invention in operation.

FIG. 1 shows a vessel 10 floating at the surface 12 of a body of water 20. The vessel includes a vertical opening or "moon pool" 14 through its hull. The moon pool is typically located at the center of the vessel in order to avoid destabilizing the vessel due to operations being carried out. The vessel is provided with a support, such as a wireline rig or coiled tubing inserter 16, that is used for lowering equipment into the well. A riser string 118 carries the wireline or coiled tubing through the wellhead assembly 102 into the borehole (well) 104. Details of the wellhead assembly and other devices associated with connecting the riser string 118 to the wellhead are not shown.

Ocean currents, ocean waves and the like will cause movement of the vessel 10 at the surface 12 relative to the fixed wellhead assembly 102 at the bottom of the body of water. The motion may be vertical (surge or heave), horizontal (drift) or rotational (yaw, pitch and roll). Drillships are usually provided with thrusters to compensate for the drift of the vessel. Additional mechanisms have to be provided for compensate for the other types of motion to avoid damage to the riser that is fixed to the ocean bottom and vessel. At the top of the riser string is a flowhead assembly 32 in the moon pool 14. A motion compensating system (not shown) compensates for relative motion of the riser string 118 and the vessel 10. Such motion compensating systems will still result in a relative motion between the flowhead assembly 32 and the vessel. The present invention is part of a decoupling assembly 30 that is adapted to decouple the motion of the flowhead assembly 32 from that of the riser string 118, so that equipment changes required for workover operations may be safely carried out on the flowhead assembly.

Figure 2:
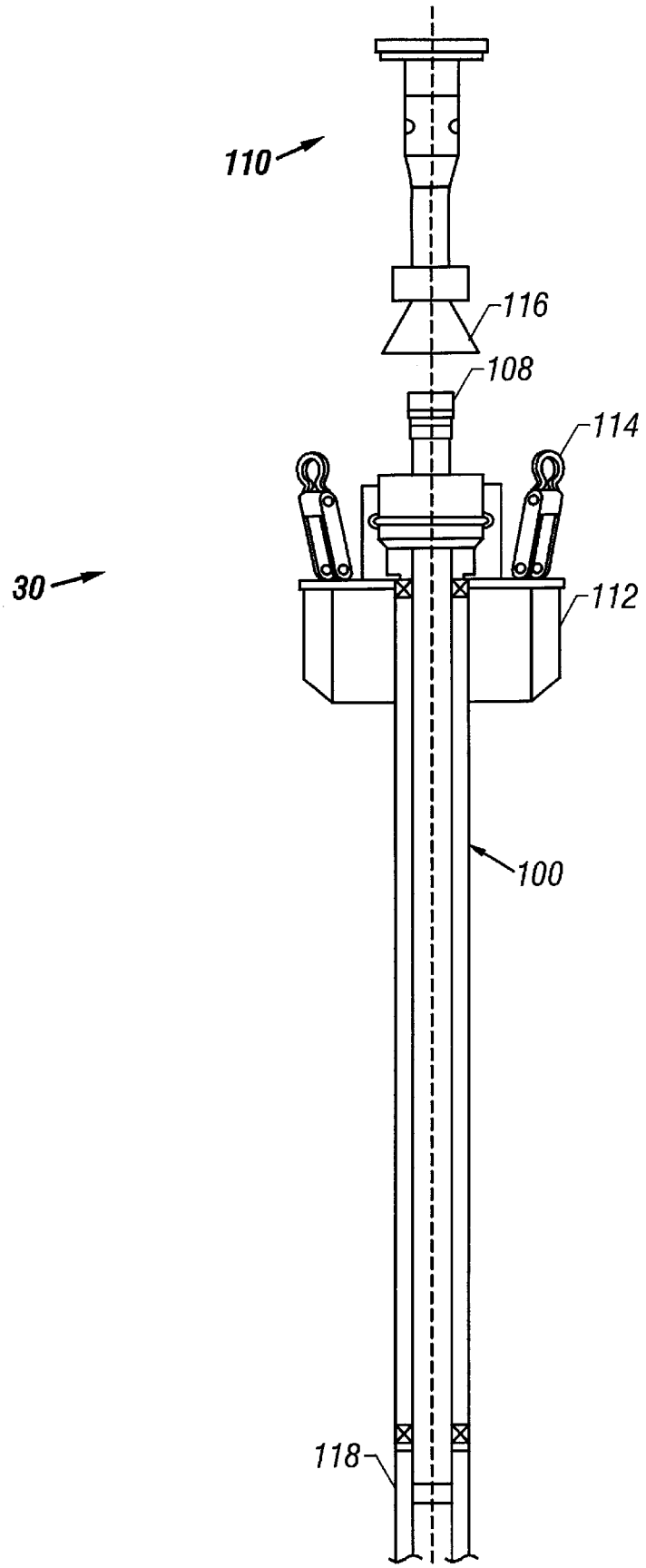
FIG. 2 is a view of an embodiment of the flexible slip joint
Figure 3:
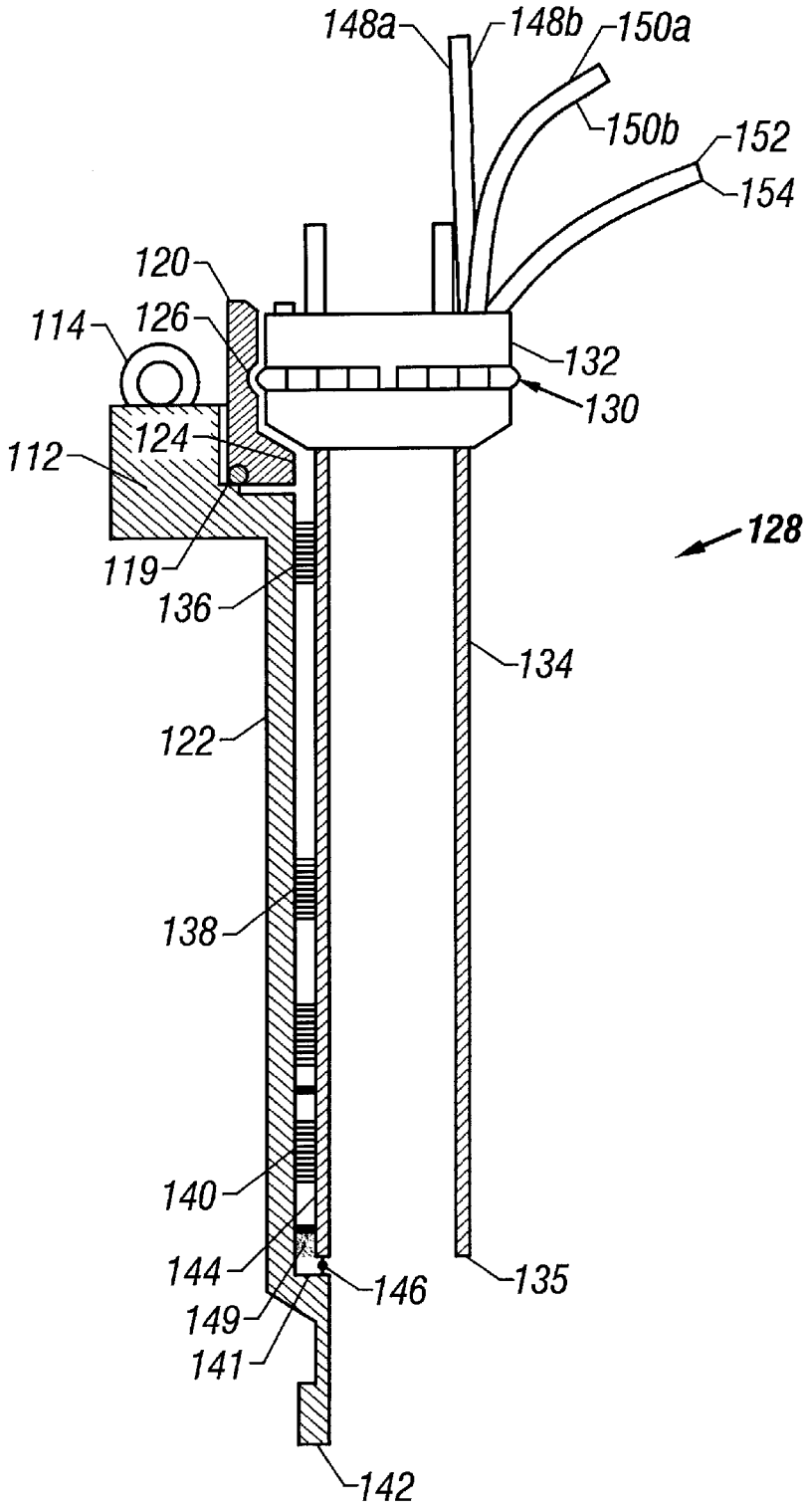
FIG. 3 is a sectional view of a flexible slip joint.

Turning now to FIGS. 2 and 3, the main components of the decoupling assembly are shown. Conceptually, it can be considered to have two main components: one component that is fixed to the riser string 118 and a second component that is fixed to the flowhead assembly 32. The first and second components are designed to move in unison when locked together by a locking mechanism and to be decoupled when unlocked by the locking mechanism.

The lower part includes a pressurized slip joint assembly 100 connected at its lower end to the top of the riser string 118. The top of the slip joint assembly 100 is connected by means of a collet connector and guide funnel 116 to a flexible joint assembly 110. In a preferred embodiment of the invention, a hydraulic quick connect device is used for coupling the flexible joint assembly to the top end 108 of the slip joint assembly. Such quick connect devices would be known to those versed in the art and are not discussed further. For illustrative purposes, the slip joint assembly 100 and the flexible joint assembly 110 have been shown in a disconnected position. The purpose of the flexible joint assembly is to compensate for the yaw, roll and pitch of the vessel relative to the riser string 118. The top of the flexible joint assembly 110 is connected to a flowhead assembly (not shown in FIGS. 2 and 3) in the moon pool of the vessel. The flexible joint assembly includes a flex joint and may also include a swivel joint. Flex joints and swivel joints would be known to those versed in the art and are not discussed further.

Shown near the top end 108 of slip joint assembly 100 and enclosing it is part of the tension assembly for keeping the riser 18 under tension. A rotational tension ring 112 surrounds the slip joint assembly. The tension ring 112 is provided with lugs 114 through which cables (not shown) are passed. Such tension assemblies for keeping risers under tension would be known to those versed in the art and are not discussed here.

FIG. 3 shows a partial sectional view of the slip joint assembly. For clarity, it is shown disengaged from the flexible joint assembly 110. The rotational tension ring 112 is shown along with the lugs 114. The rotational tension ring 112 and a downwardly extending cylindrical portion 122 may be considered to define a substantially cylindrical outer housing. Supported inside the rotational tension ring 112 by bearings 119 is an inner housing 120. This allows rotational movement between the inner housing 120 and the tension ring 112. The inner housing is of substantially cylindrical shape with a lip 124 at its lower end. Extending circumferentially around the inside wall of the inner housing is a groove 126. Near the bottom of the cylindrical portion 122 and on its inside is a shoulder 141. A quick connect device 142 at the bottom of the outer housing is used to connect the slip joint assembly to the riser 118 (not shown in FIG. 3).

The sliding member 128 of the slip joint assembly has a head 132 and a downwardly extending cylindrical body 134. The head is sized to fit on the inside of the inner housing 120 while the body (a liner) 134 is sized to fit inside the outer housing. The head is provided with a lockdown ring (or segments of a lockdown ring) 130 that is designed to engage the cylindrical groove 126 of the inner housing in a locked position and to allow slidable movement (in a vertical direction) of the sliding member in an unlocked position. The sliding member is provided with a number of hydraulic leads to control its operation. These are labeled 148, 150, 152, and 154 and are discussed below.

When the sliding member 128 is in the locked position, the bottom end 135 of the body 134 forms a metal-to-metal seal 146 against the shoulder 141 on the outer housing. This seal 146 forms the primary high pressure seal when sliding member 128 is in the locked position. Secondary 140 and tertiary 138 high pressure seals are also provided between the body 134 of the sliding member and the outer housing 122 as a backup to the primary high pressure seal 146. The secondary and tertiary seals are preferably made of elastomeric material. In addition, a dynamic low pressure seal 136 is also provided for the annulus between the body 134 of the sliding member and the outer housing 122.

A plurality of hydraulic leads that perform various functions lead into the head 132 of the sliding member. Leads 148*a*, 148*b* and 150*a*, 150*b* activate the latch/unlatch and the lock/unlock mechanism of the lockdown ring 130. Lead 152 activates the dynamic low pressure seal 136. Lead 154 is provided to monitor the pressure in the space 144 between the primary 146 and secondary 140 seals. A pressure monitor 149 is used for the purpose. This may also be used to monitor the position of the sliding member 128 relative to the outer housing and hence the integrity of the primary metal-to-metal seal.

The operation of the slip joint is now discussed. Under normal conditions, wellhead assembly is in the open position and the inside of the riser 118 would be at high pressure. The riser string 118, the rotational tension ring 112, the flexible joint assembly 110 ( and the flowhead assembly in the moon pool of the vessel, not shown) move in unison, so that there may be relative motion between the flowhead assembly and the vessel. The dynamic low pressure seal 136 may be inoperative at this time. When it is desired to perform workover operations, e.g., run a wireline, the wellhead assembly is closed so that there is no direct communication between the inside of riser string 118 and the well 104. The pressure inside the riser assembly is bled down and the locking ring 130 is disengaged. This allows relative motion between the body 134 of the sliding member and the outer housing 122. The low pressure dynamic seal is activated. In this configuration, the flowhead assembly (not shown) above the sliding member 128 and the flexible joint assembly 110 is decoupled from the riser string 118. Tool changeover may safely be performed by humans in the moon pool. Once the new tools have been inserted into the flowhead assembly and lowered to the well head, the lockdown ring 130 is engaged, and the wellhead opened up. In this manner, the invention makes it possible to decouple relative motion of the upper end of the riser assembly from the lower end of the riser assembly.

To connect the slip joint, the slip joint is closed by stroking the inner liner 134 fully into the outer housing item 122. Pressure is applied down a hydraulic line 148*a* to activate the lockdown ring or collet mechanism 130. The lockdown ring 130 engages the groove 126 to lock the inner liner 134 and outer housing together and providing the force to seal the metal—metal seal 146. Pressure is then applied down line 150*a* to lock the lockdown ring 130 in place preventing accidental unlatching of lockdown ring 130 from the groove 126. To monitor the status of the primary seal during well operations line 154 is used as a monitor line from the pressure monitor 149.

To disconnect the slip joint, pressure is applied down line 150*b* to unlock the lockdown ring. Pressure is applied down line 148*b* to unlatch ring 130 from groove 126. The slip joint is then free to move with vessel motion. Line 152 provides a positive LP dynamic seal (air or hydraulic fluid) to prevent loss of wellbore fluids to the environment and may also provide lubrication for the slip joint during movement of the inner to the outer barrel (although lubrication may come from an alternative source). The sliding members (inner barrel and outer housing) are not controlled by hydraulic lines. The lifting and lowering of inner barrel to outer housing is provided by means of a external lifting device on the vessel. Motion between these items 122 and 134 is the motion of the vessel relative to the seabed during the unlatched state of the lockdown ring.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A slip joint assembly for use with a riser string and a vessel in a body of water, the vessel having a tensioning mechanism and a flowhead assembly, said riser string operatively connected to a wellhead at the bottom of the water, the slip joint assembly comprising:

(a) a first member having (i) a substantially cylindrical outer housing coupled to a top end of the riser string by a connection device at a bottom end of said outer housing, and (ii) a tension ring coupled to the tensioning mechanism to allow relative vertical movement between the riser string and the vessel, said tension ring disposed between a top end of said outer housing and the tensioning mechanism; and (b) a second member operatively coupled to the flowhead assembly, and in slidable contact with the first member upon insertion into the first member, the second member having a locking mechanism adapted to operate between a locked position in which the second member is locked to the first member, and an unlocked position in which the second member is free to move relative to the first member.

2. The slip joint assembly of claim 1, the first member further comprising a substantially cylindrical inner housing supported by a bearing on the outer housing proximate to the top end of the outer housing, the bearing allowing rotational movement of said inner housing relative to the outer housing, and wherein the locking mechanism engages a circumferential groove on the inner housing.

3. The slip joint assembly of claim 2, the second member further comprising a body having said locking mechanism and a liner extending downwardly from said body, the liner adapted to form a sealing contact at a bottom end of the liner to a shoulder near the bottom of the outer housing when the second member is inserted into the first member and locked thereto.

4. The slip joint assembly of claim 3 further comprising at least one additional seal in an annulus between the second member and the outer housing.

5. The slip joint assembly of claim 4 wherein the at least one additional seal comprises at least one high pressure seal and a low pressure seal.

6. The slip joint assembly of claim 5 wherein the at least one high pressure seal comprises two high pressure seals.

7. The slip joint assembly of claim 2, the locking mechanism further comprising a locking ring.

8. The slip joint assembly of claim 4 further comprising a pressure monitor between the at least one additional seal and the sealing contact between the first member and the shoulder on the outer housing.

9. The slip join assembly of claim 5 wherein the at least one high pressure seal is made of elastomeric material.

10. The slip joint assembly of claim 1 wherein the connection device is a quick connect device.

11. The slip joint assembly of claim 1 wherein the second member is adapted to be coupled to a flexible joint assembly by means of a collet and funnel arrangement including a hydraulic quick release mechanism, said flexible joint assembly coupled to the flowhead assembly.

12. The slip joint assembly of claim 1 further comprising at least one hydraulic lead adapted to perform at least one task selected from: (i) operating a lock on the locking mechanism, (ii) operating a latch on the locking mechanism, (iii) operating a low pressure seal between the first and second members, (iv) monitoring the relative positions of the first and second members, and (v) monitoring pressure at a location between the first and second members.

13. A method of using a flowhead assembly on a vessel on a body of water with a riser string coupled to a wellhead at the bottom of the body of water, the method comprising:

(a) coupling a first member of a slip joint assembly to a top end of the riser string by a connection device, (b) coupling the first member of the slip joint assembly to a tensioning mechanism on the vessel to allow relative vertical movement between the riser string and the vessel;

(c) operatively coupling a second member of a slip joint assembly to the flowhead assembly;

(d) inserting the second member of the slip joint assembly into the first member to allow relative movement between the first and second members;

(e) using a locking mechanism on the second member to lock the second member to the first member to operatively couple the flowhead assembly to the riser string, and (f) performing operations at the flowhead assembly independent of relative movement between the riser string and the vessel.

14. The method of claim 13 further comprising using a low pressure dynamic seal between the first and second members.

15. The method of claim 13 further comprising monitoring pressure between the first and second members.

16. The method of claim 13 further comprising determining a position of the second member relative to the first member.

17. The method of claim 13 further comprising using at least one hydraulic lead coupled to the slip joint assembly for one or more of the tasks selected from: (i) operating a lock on the locking mechanism, (ii) operating a latch on the locking mechanism, (iii) operating a low pressure seal between the first and second members, (iv) monitoring the relative positions of the first and second members, and (v) monitoring pressure at a location between the first and second members.

* * * * *